US010801192B2

(12) United States Patent
Wilson

(10) Patent No.: US 10,801,192 B2
(45) Date of Patent: Oct. 13, 2020

(54) SHOWER HEAD LIQUID AGENT DISPENSER

(71) Applicant: Sydonia Wilson, Sanford, FL (US)

(72) Inventor: John Wilson, New Haven, CT (US)

( * ) Notice: Subject to any disclaimer, the term of this patent is extended or adjusted under 35 U.S.C. 154(b) by 0 days.

(21) Appl. No.: 15/178,832

(22) Filed: Jun. 10, 2016

(65) Prior Publication Data

US 2017/0356171 A1 Dec. 14, 2017

(51) Int. Cl.

| | |
|---|---|
| ***E03C 1/046*** | (2006.01) |
| ***A47K 5/12*** | (2006.01) |
| ***E03C 1/084*** | (2006.01) |
| ***B05B 7/24*** | (2006.01) |
| *B05B 1/18* | (2006.01) |

(52) U.S. Cl.

CPC ..... *E03C 1/046* (2013.01); *A47K 5/12* (2013.01); *B05B 7/2443* (2013.01); *E03C 1/084* (2013.01); *B05B 1/18* (2013.01)

(58) Field of Classification Search

CPC ..... E03C 1/046; E03C 1/084; A47K 5/12; B05B 1/185; B05B 1/18; B05B 1/2443

USPC ..... 239/310

See application file for complete search history.

(56) References Cited

U.S. PATENT DOCUMENTS 2,325,242 A * 7/1943 Arthur ..... E03C 1/046 137/581
2,588,255 A * 3/1952 Larsh ..... E03C 1/046 239/310
3,083,915 A * 4/1963 Grauel ..... B05B 7/2443 239/310
3,207,445 A * 9/1965 Court ..... E03C 1/046 222/630
3,231,200 A * 1/1966 Heald ..... E03C 1/046 239/318
3,446,438 A * 5/1969 Watson ..... E03C 1/046 100/229 R
3,612,404 A * 10/1971 Vicari ..... E03C 1/046 239/260
4,189,100 A * 2/1980 Karp ..... B05B 7/12 239/310
4,191,332 A * 3/1980 De Langis ..... B05B 1/3026 239/428.5
4,219,158 A * 8/1980 Lacy ..... E03C 1/046 239/222.19
4,623,095 A * 11/1986 Pronk ..... E03C 1/046 239/311
5,071,070 A * 12/1991 Hardy ..... B05B 7/2443 222/132
5,356,076 A * 10/1994 Bishop ..... E03C 1/046 239/311
5,716,006 A * 2/1998 Lott ..... B05B 1/265 239/318
6,045,060 A * 4/2000 Hudson ..... B05B 7/2443 239/310

(Continued)

*Primary Examiner* — Qingzhang Zhou

(74) *Attorney, Agent, or Firm* — Jason T. Daniel, Esq.; Daniel Law Offices, P.A.

(57) ABSTRACT

A shower head liquid agent dispenser includes a storage tank having a hollow interior space for storing a liquid agent, a first tubular member that is connected to the bottom end of the storage tank, a valve which can be manipulated between an on and off position, a second tubular member that is connected to a tee fitting which is selectively connected to a building's shower arm and a shower head assembly.

17 Claims, 2 Drawing Sheets

(56) References Cited

U.S. PATENT DOCUMENTS

| | | | | |
|---|---|---|---|---|
| 6,233,756 | B1 * | 5/2001 | Holbrook, Sr. | E03C 1/046 239/312 |
| 7,320,438 | B1 * | 1/2008 | Latin | E03C 1/046 239/305 |
| 8,070,074 | B2 * | 12/2011 | Craig | B01F 5/0496 239/310 |
| 8,453,667 | B2 * | 6/2013 | Li | F15D 1/025 137/101.11 |
| 2002/0033424 | A1 * | 3/2002 | Rivera | E03C 1/046 239/310 |
| 2006/0144861 | A1 * | 7/2006 | Harrison | A47K 5/12 222/173 |
| 2008/0302885 | A1 * | 12/2008 | O'Brien | B05B 7/2443 239/310 |

* cited by examiner

SHOWER HEAD LIQUID AGENT DISPENSER

TECHNICAL FIELD

The present invention relates generally to shower accessories, and more particularly to a liquid agent dispenser for use with a shower head.

BACKGROUND

The statements in this section merely provide background information related to the present disclosure and may not constitute prior art.

While taking a shower it is common to utilize some type of cleaning agent such as soap, shampoo, conditioner, and/or body wash, for example to ensure a user is able to thoroughly clean their body. As such, residential showers are often littered with many different bottles that are often scattered along the floor and/or shelves. When so located, users may have difficulty identifying a proper bottle, or may slip on a bottle while bathing under the shower stream.

In addition to the above, commercial locations such as hotels, motels and locker rooms, for example, typically spend thousands of dollars each year to provide their guests with individual bottles of body wash and/or bars of soap, for example, which are discarded upon being opened by a guest. Such a process results in a huge waste of money and materials.

Regardless of where the shower is located, users must still dispense the cleaning agent directly onto their body and then manually spread the agent across their body as it encounters the shower stream. However, such a process often results in an uneven distribution of the cleaning agent, as some body portions are easier to access than others.

Accordingly, it would be beneficial to provide a liquid agent dispenser that can store and dispense any type of liquid agent directly into a shower head, so as to alleviate the drawbacks of the above noted devices.

SUMMARY OF THE INVENTION

The present invention is directed to a shower head liquid agent dispenser. One embodiment of the present invention can include a storage tank having a hollow interior space for storing a liquid agent such as soap, shampoo, conditioner and/or body wash. A first tubular member is connected to the bottom end of the storage tank and functions to feed the stored agent to a valve which can be manipulated by a user to between an on and off position, in order to control an operation of the device. A second tubular member can feed the liquid agent into a tee fitting which is connected to a building's shower arm. The tee fitting can function to mix the liquid agent with shower water and dispense the same into the shower head.

Another embodiment of the present invention can include an aerator that is interposed between the tee fitting and the shower arm.

Yet another embodiment of the present invention can include a shower head having the above described liquid agent dispenser secured thereon.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
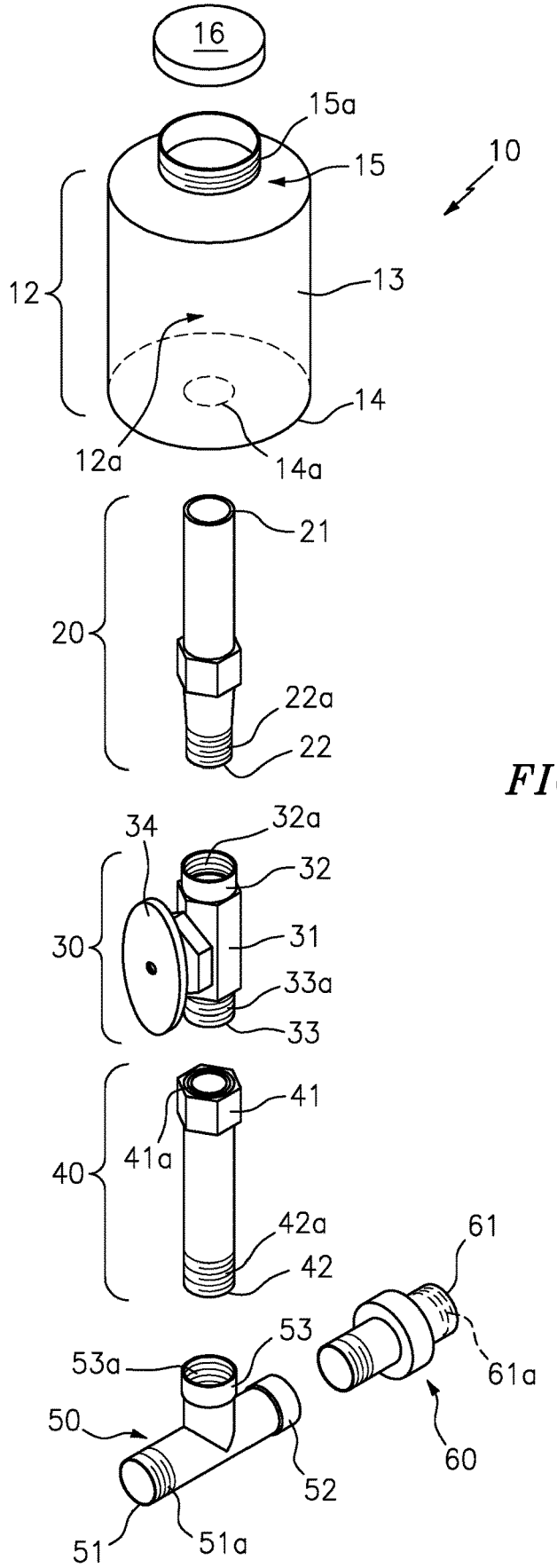
FIG. 1 is an exploded parts view of a shower head liquid agent dispenser that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured," and derivatives thereof shall be used to describe a situation wherein two or more objects are joined together in a non-permanent manner so as to allow the same objects to be repeatedly joined and separated.

As described herein, the terms "connector," "complementary connector" and derivatives thereof can include any number of different elements capable of repeatedly securing two items together in a nonpermanent manner. In the illustrated examples, the preferred connector utilizes a plurality of embedded elements forming a screw thread along an outside periphery of one component, and another plurality of embedded elements forming a screw thread along an inside periphery of a second component. As is known to those of skill in the art, such threaded elements can act to removably connect the illustrated components together in a secure and watertight manner. Threaded elements having lands and grooves for securing complementary objects together via a twisting motion are extremely well known.

Although described above as utilizing threaded elements capable of creating a secure attachment point between two objects when a rotational force is applied thereto, this is for illustrative purposes only, as any number of devices capable of creating a removable seal between two items can also be utilized. Several nonlimiting examples include opposing strips of hook and loop material (i.e. Velcro®), magnetic elements, tethers such as straps and ties, and compression fittings such as hooks, snaps and buttons, for example. Each illustrated connector can be permanently secured to the illustrated portion of the device via a permanent sealer such as glue, adhesive tape, or stitching, for example.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
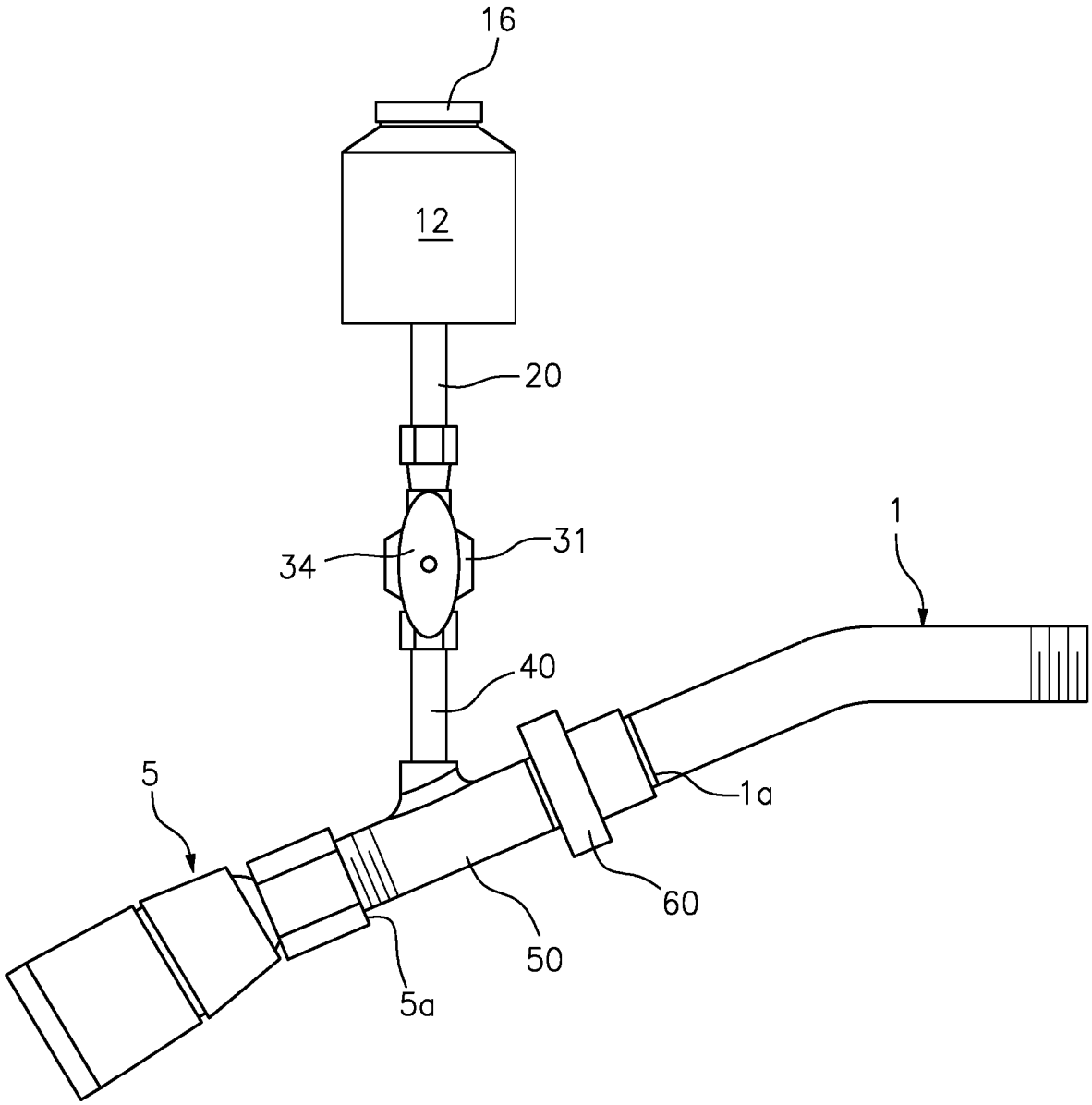
FIG. 2 is a perspective view of the shower head liquid agent dispenser in operation, in accordance with another embodiment of the invention.

FIGS. 1 and 2 illustrate one embodiment of a liquid agent dispenser 10 for use with a shower head assembly, that is useful for understanding the inventive concepts described herein. As shown, one embodiment of the dispenser 10 can include, essentially, a storage tank 12, a first tubular member 20, a valve 30, a second cylindrical member 40, a tee fitting 50 and an aerator 60. Each of these components can be joined together and attached to a shower head assembly (See FIG. 2) to dispense any type of liquid agent that is stored in the tank 12 through the shower head assembly.

The tank 12 can function to store any type of liquid dispensing agents such as various soaps, shampoo, conditioner and/or body wash, for example. As described herein, the tank 12 can include a continuous outer wall 13 having a bottom end 14 and a neck 15 along the top end. The tank can include a hollow interior space 12*a* that is accessible via the neck 15 and an aperture 14*a* positioned within the bottom end. A cap 16 can be removably secured along the neck 15 via a connector such as the illustrated screw threads 15*a*, for example.

The first tubular member 20 can function to transfer the stored liquid agent from the tank 12 to the valve 30. In one embodiment, the member 20 can include a generally hollow conduit having an open first end 21, and an open second end 22. The first end 21 can include a shape and size that is complementary to the shape and size of the aperture 14*a* of the tank 12. The first end 21 can be mated with the aperture 14*a* via any number of known methodologies such as welding or via threaded elements (not illustrated), for example, so as to form a watertight seal that allows the stored liquid agent to enter the open first end of the tubular member 20.

In the preferred embodiment, the second end 22 of the first tubular member 20 can be removably secured to the below described valve 30 via a connector such as the illustrated threaded elements 22*a* and 32*a*, for example.

The valve 30 can function to allow a user to selectively allow and prevent dispensing of the liquid agent into the shower head assembly. In one embodiment, the valve 30 can include a main body 31, having a first end 32, a second end 33, and rotatable handle 34. Turning the handle 34 raises or lowers an internal valve pin which, respectively, allows fluid to pass through the valve body 31 and the ends 32 and 33.

The second tubular member 40 can function to transfer the liquid agent from the valve 30 to the T-shaped connector 50. In one embodiment, the member 40 can include a generally hollow conduit having an open first end 41, and an open second end 42. The first end 41 can be removably secured to the second end 33 of the valve 30 via a connector such as the illustrated threaded elements 41*a* and 33*a*, for example. Likewise, the second end of the second member 42 can be removably secured to the middle opening 53 of the below described tee fitting 50 via a connector such as the illustrated threaded elements 42*a* and 53*a*, for example.

The tee fitting 50 can function to introduce the liquid agent into the stream of water. In one embodiment, the tee fitting can include an open first end 51, an open second end 52, and a middle opening 53. The middle opening 53 can be removably secured to the second end 42 of the second member 40 via a connector such as the illustrated threaded elements 42*a* and 53*a*, for example. The first end of the tee fitting 51 can be removably secured to the threaded end 5*a* of a conventional shower head assembly 5 via a connector such as the illustrated threaded elements 51*a*, for example.

An aerator 60 can be secured within, or connected to the second end 52 of the tee fitting 50 and can function to reduce the flow and/or pressure of water entering the fitting so as to allow the liquid agent to be introduced to the water flowing through the tee fitting. As shown, one end of the aerator 61 can be removably secured to the threaded end 1*a* of a conventional building shower arm 1 via a connector such as the illustrated threaded elements 61*a*, for example.

As described herein, each of the tank 12, the first tubular member 20, the valve 30, the second tubular member 40, the tee fitting 50 and the aerator 60 can be constructed from any number of different lightweight and durable materials that are resistant to oxidization and corrosion. Several nonlimiting examples can include, for example, stainless steel, hard plastic, composite materials, and the like. Moreover, each of these components can be constructed from identical construction materials or can be constructed from different materials.

In operation, the tee fastener of device 10 can be interposed between an existing shower arm 1 and shower head assembly 5, with the storage tank 12 located above the same. When so positioned, a user can operate the shower controls (not shown) so that shower water flows through the tee fitting 50 and exits through the shower head 5. When a user desires to mix the shower water with the liquid agent stored within the tank 12, the user can rotate the handle 34 of the valve 30, so as to allow the liquid agent to be gravity fed down through the second tubular member 40 and into the tee fitting.

At this time, the velocity and turbulence of the shower water exiting the aerator 60 thoroughly mixes with the liquid agent inside the tee fitting (i.e., shower mixture). As such, the combined shower water and liquid agent exit through the shower head 5 so that the user receives soapy water for showering and washing. As necessary, the user can vary the amount of liquid agent entering the water supply by adjusting the rotation of the valve handle 34.

As such, the supply of liquid soap is easily accessible to the person taking a shower. Furthermore, the supply of liquid soap stored within the soap tank 12 exceeds the capacity of conventional bar soaps and containers of liquid soaps.

As described herein, one or more elements of the shower head liquid agent dispenser 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the storage tank 12, the first tubular member 20, the valve 30, the second cylindrical member 40, the tee fitting 50 and/or the aerator 60, for example, may be formed together as one or more continuous elements, either through manufacturing processes, such as welding, casting, or molding, or through the use of a singular piece of material milled or machined with the aforementioned components forming identifiable sections thereof.

To this end, in another embodiment, the ends of the valve 30 can be in direct communication with each of the storage tank 12 and the tee fastener, thereby eliminating the first and second tubular members. Moreover, in yet another embodiment, each of the above described components can be formed integrally with a new shower head assembly and/or shower arm, for example, so as to provide a single integrated product incorporating the combined functionality of the above described components.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A liquid agent dispensing device for use with a shower arm and a shower head assembly, said device comprising: a storage tank having a hollow interior space for storing a liquid agent, said storage tank having an outer wall and a bottom end, said bottom end having an aperture for dispensing the liquid agent from the storage tank; a tee fitting having an inlet end, an outlet end and a middle opening, said outlet end including a connector that is configured to engage the shower head assembly; a valve that is removably interposed between the bottom end of the storage tank and the middle opening of the tee fitting, said valve including a first end, a second end and a rotatable handle, said valve positioned to keep the storage tank above the shower head assembly; and an aerator having an outlet end and an inlet end is a thread connector that is configured to engage the shower arm, wherein the aerator has a portion between the inlet end and the outlet end, a diameter of the portion is larger than the inlet end and the outlet end of the aerator: wherein the outlet end of the aerator comprises a thread connector that is in removably direct contact with the inlet end of the tee fitting, wherein the aerator reduces pressure of fresh water entering the tee fitting to allow the liquid agent to be introduced to the fresh water flowing through the tee fitting, wherein the storage tank is configured to gravity feed the stored liquid agent through the aperture into the tee fitting when the valve is in an open position, and the aerator is configured to mix the stored liquid agent with the fresh water inside the tee fitting before exiting the first end of the tee fitting.

2. The device of claim 1, further comprising:

a first tubular member that is interposed between the first end of the valve and the storage tank aperture, said first tubular member functioning to transport the stored liquid agent from the storage tank to the valve.

3. The device of claim 2, further comprising:

a second tubular member that is interposed between the second end of the valve and the middle opening of the tee fitting, said second tubular member functioning to transport the stored liquid agent from the valve to the tee fitting when the valve is in the open position.

4. The device of claim 3, wherein each of the storage tank, the first tubular member, the valve, the second tubular member and the tee fitting are removably secured together.

5. The device of claim 4, further comprising a plurality of connectors that are disposed between each of the storage tank, the first tubular member, the valve, the second tubular member and the tee fitting.

6. The device of claim 5, wherein each of the plurality of connectors include threaded elements.

7. The device of claim 1, wherein each of the storage tank, the valve, and the tee fitting are constructed from a corrosion resistant material.

8. A shower head device for use with a shower arm, said device comprising: a storage tank having a hollow interior space for storing a liquid agent, said storage tank having an outer wall and a bottom end, said bottom end having an aperture for dispensing the liquid agent from the storage tank; a tee fitting having an inlet end, an outlet end and a middle opening; a shower head assembly that is in communication with the outlet end of the tee fitting; a valve that is removably interposed between the bottom end of the storage tank and the middle opening of the tee fitting, said valve including a first end, a second end and a rotatable handle, said valve positioned to keep the storage tank above the shower head assembly; and an aerator having an outlet end and an inlet end is a thread connector that is configured to engage the shower arm, wherein the aerator has a portion between the inlet end and the outlet end, a diameter of the portion is larger than the inlet end and the outlet end of the aerator: wherein the outlet end of the aerator comprises a thread connector that is in removably direct contact with the inlet end of the tee fitting, wherein the aerator reduces pressure of shower water entering the tee fitting to allow the liquid agent to be introduced to the shower water flowing through the tee fitting, wherein the storage tank is configured to gravity feed the stored liquid agent through the aperture into the tee fitting when the valve is in an open position, and the aerator is configured to deposit the shower water into the tee fitting to create a shower mixture inside the tee fitting, and the shower head assembly is configured to dispense the shower mixture.

9. The device of claim 8, wherein the storage tank further includes a neck having an opening and a removable cap.

10. The device of claim 8, further comprising:

a first tubular member that is interposed between the first end of the valve and the storage tank aperture, said first tubular member functioning to transport the stored liquid agent from the storage tank to the valve.

11. The device of claim 10, further comprising:

a second tubular member that is interposed between the second end of the valve and the middle opening of the tee fitting, said second tubular member functioning to transport the stored liquid agent from the valve to the tee fitting when the valve is in the open position.

12. The device of claim 11, wherein each of the storage tank, the first tubular member, the valve, the second tubular member, the tee fitting and the shower head assembly are removably secured together.

13. The device of claim 12, further comprising a plurality of connectors that are disposed between each of the storage tank, the first tubular member, the valve, the second tubular member, the tee fitting and the shower head assembly.

14. The device of claim 13, wherein each of the plurality of connectors include threaded elements.

15. The device of claim 8, wherein each of the storage tank, the valve, the tee fitting and the shower head are constructed from a corrosion resistant material.

16. A liquid agent dispensing device for use with a shower arm and a shower head assembly, said device consisting of: a storage tank having a hollow interior space for storing a liquid agent, said storage tank having an outer wall and a bottom end, said bottom end having an aperture for dispensing the liquid agent from the storage tank; a tee fitting having an inlet end, an outlet end and a middle opening, said outlet end including a connector that is configured to engage the shower head assembly; a valve that is removably interposed between the bottom end of the storage tank and the middle opening of the tee fitting, said valve including a first end, a second end and a rotatable handle, said valve positioned to keep the storage tank above the shower head assembly; and an aerator having an outlet end, and an inlet end is a thread connector that is configured to engage the shower arm, wherein the aerator has a portion between the inlet end and the outlet end, a diameter of the portion is larger than the inlet end and the outlet end of the aerator; wherein the outlet end of the aerator comprises a thread connector that is in removably direct contact with the inlet end of the tee fitting, wherein the aerator reduces pressure of fresh water entering the tee fitting to allow the liquid agent to be introduced to the fresh water flowing through the tee fitting, wherein the storage tank is configured to gravity feed the stored liquid agent through the aperture into the tee fitting when the valve is in an open position, wherein the stored liquid agent mixes with the fresh water inside the tee fitting before exiting the tee fitting.

17. The device of claim 1, wherein the aerator reduces flow of the fresh water entering the tee fitting.

* * * * *